United States Patent [19]

Luke

[11] 3,950,948

[45] Apr. 20, 1976

[54] AUTOMATIC REMOTE CONTROL APPARATUS

[75] Inventor: William George Luke, Cornwall, England

[73] Assignee: English Clays Lovering Pochin & Company Limited, Cornwall, England

[22] Filed: Sept. 13, 1974

[21] Appl. No.: 505,845

Related U.S. Application Data

[62] Division of Ser. No. 349,463, April 9, 1973, Pat. No. 3,836,084.

[30] Foreign Application Priority Data

Apr. 14, 1972 United Kingdom ..... 17418/72

[52] U.S. Cl. ..... 60/538; 60/546; 60/574; 91/171

[51] Int. Cl.[2] ..... F15B 7/02

[58] Field of Search ..... 60/537, 538, 571, 546, 60/541, 543, 544; 91/171, 546, 569, 574

[56] References Cited

UNITED STATES PATENTS

| | | | |
|---|---|---|---|
| 2,175,800 | 10/1939 | Hodgman | 60/571 X |
| 2,392,892 | 1/1946 | Ward | 60/571 X |
| 2,587,571 | 2/1952 | Lombard | 60/538 |
| 2,999,528 | 9/1961 | Kurtak | 60/574 X |
| 3,039,513 | 6/1962 | Lasiewicz et al. | 91/171 X |
| 3,040,533 | 6/1962 | Heinrich | 60/538 |
| 3,048,976 | 8/1962 | Grigsby | 60/545 |
| 3,163,989 | 1/1965 | Maxwell | 60/538 |
| 3,513,656 | 5/1970 | Engle | 60/574 |
| 3,699,676 | 10/1972 | Beck | 60/571 X |
| 3,752,282 | 8/1973 | Espenshied | 60/538 X |
| 3,832,852 | 9/1974 | Schmucker | 60/546 |
| 3,855,794 | 12/1974 | Meyer et al. | 60/546 |

FOREIGN PATENTS OR APPLICATIONS

| | | | |
|---|---|---|---|
| 7,968 | 7/1956 | Germany | 60/571 |

*Primary Examiner*—Martin P. Schwadron
*Assistant Examiner*—H. Burks, Sr.
*Attorney, Agent, or Firm*—Armstrong, Nikaido & Wegner

[57] ABSTRACT

Hydraulic control apparatus for automatic remote control of a hydraulic actuating ram. The apparatus has a double-acting slave cylinder connectable hydraulically to an actuating ram, and a double-acting master cylinder the piston of which is mechanically connected to the piston of the slave cylinder, the master cylinder being operable by hydraulic pressure supplied via a pilot-operated valve arranged automatically to reverse the stroke of the master ram at limits set according to the desired stroke of the actuating ram. The control apparatus may be used for controlling actuating rams which effect reciprocating pivotal movement about one or more axes of a water jet monitor.

8 Claims, 5 Drawing Figures

FIG.I.

AUTOMATIC REMOTE CONTROL APPARATUS

This is a division of application Ser. No. 349,463, filed Apr. 9, 1973, and now U.S. Pat. No. 3,836,084.

BACKGROUND OF THE INVENTION

This invention relates to hydraulic control apparatus for automatic remote control of a hydraulic actuating ram, and is particularly, though not exclusively, concerned with remote control of movement of the nozzle of a high-velocity water jet monitor.

In a number of mining industries, for example the clay industry, a high-pressure water jet, from the nozzle of a water jet monitor, is used to wash minerals from the earth. This washing process has been improved in recent years by increasing the velocity of the water jet and by directing the water jet more effectively at the area to be washed, washing being carried out by traversing the jet of water continually back and forth over a selected area of the earth. Because of the high pressure of water involved and the time required to wash a particular area effectively it is desirable to employ remote control of the movement of the nozzle so that the operator can supervise the monitor from a safe distance and avoid repetitive manual control over long periods. One method of traversing the jet back and forth is by adapting the nozzle of the monitor to be movable, for example by pivoting, by means of a hydraulic actuating ram or rams.

SUMMARY OF THE INVENTION

According to one aspect of the present invention there is provided hydraulic control apparatus for automatic remote control of a hydraulic actuating ram, comprising a first double-acting cylinder, referred to as a slave cylinder, which can be connected hydraulically for driving the actuating ram, and a second double-acting cylinder, referred to as a master cylinder, the piston of the slave cylinder being mechanically connected to the piston of the master cylinder whereby reciprocating movement of the master piston causes corresponding reciprocating movement of the slave piston, the master cylinder being operable by hydraulic pressure under the control of a pilot-operated hydraulic valve which is arranged automatically to reverse the direction of movement of the master ram in response to pilot means actuable by limit switch means arranged for determining the desired length of stroke of the actuating ram.

The pilot means may comprise two hydraulic pilot valves arranged to be actuated at completion of a preset stroke of the master or slave rams for example by latches which are adjustable so that their position determines the length of stroke of the master ram.

The control apparatus may include a manually-operable hydraulic valve for controlling the hydraulic actuating ram, the manual valve, when operated, overriding the automatic control of the master and slave cylinders.

In one embodiment of the invention there is provided a water jet monitor including a nozzle mounted for pivotal movement in at least one plane, the pivotal movement being effected by means of a hydraulic actuating ram which is arranged to be controlled automatically by hydraulic control apparatus according to the invention. Conveniently a flow control valve is connected between the slave cylinder and the actuating ram for controlling the rate of movement of the actuating ram, thereby controlling the rate of pivotal movement of the monitor nozzle.

In practice, it is often desirable to control the movement of a monitor nozzle so that the water jet traverses an area to be washed in a horizontal direction, or a vertical direction, or in both horizontal and vertical directions simultaneously. In a preferred embodiment of the invention therefore, a water jet monitor is provided in which the nozzle is mounted for pivotal movement in two mutually perpendicular planes, a first actuating ram being provided for effecting movement of the nozzle in one plane and a second actuating ram being provided for effecting movement of the nozzle in the other plane, each actuating ram being arranged to be remotely controlled automatically by hydraulic control apparatus according to the invention. In this way the control apparatus may be set so as to control automatically the movement of the monitor nozzle for a large variety of different washing programmes, by selecting the stroke and speed of movement of each actuating ram, for example, in both the vertical and horizontal directions.

The hydraulic pressure for each master cylinder of the control apparatus may be supplied from a pump driven by an electric motor. This does have the disadvantage, however, of requiring installation of electrical power lines which are both costly, awkward to move when the monitor is to be moved to a new location, and constitute a hazard in a mining pit where heavy vehicles are usually operated.

According to a further aspect of the invention therefore, there is provided a high velocity water jet monitor wherein the hydraulic pressure for operating control apparatus of the water jet monitor is supplied by a pump which is coupled to a hydraulic motor driven by means of water pressure derived from the supply of water to the nozzle of the monitor. The power unit is thus self-contained and therefore avoids the hazards mentioned above, and moreover it can easily be moved to a new location together with the control apparatus and the monitor for washing different areas of the mining pit. Conveniently the hydraulic motor comprises a Pelton wheel.

BRIEF DESCRIPTION OF THE DRAWINGS

The invention may be carried into practice in various ways, but one specific embodiment will now be described, by way of example, with reference to the accompanying drawings, in which.

DETAILED DESCRIPTION OF THE PREFERRED EMBODIMENT

Figure 1:
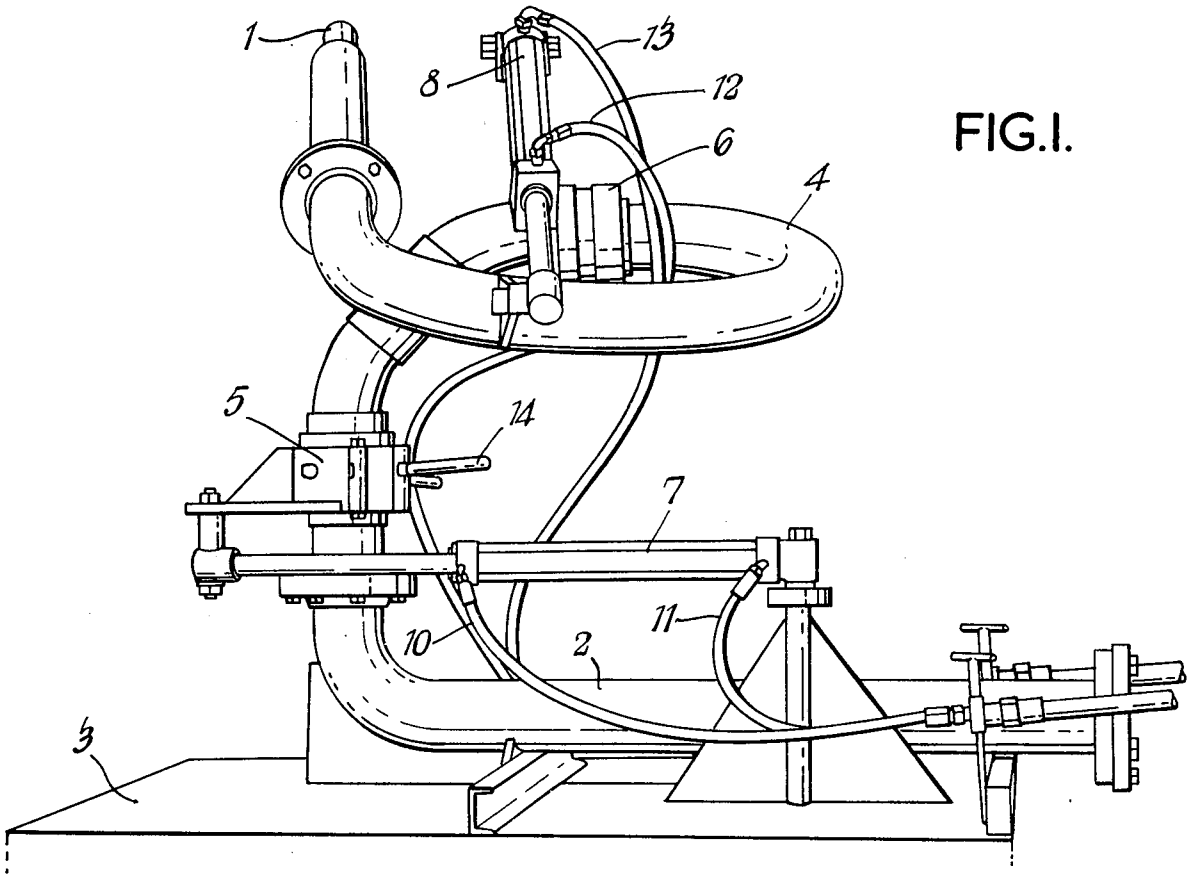
FIG. 1 is a view of a high-velocity water jet monitor having a nozzle which can be pivoted horizontally and vertically.

A high-velocity water jet monitor such as is used in the china-clay industry for washing china-clay from the earth is shown generally in FIG. 1. The monitor has a nozzle 1 from which a high-velocity jet of water issues when the monitor is in use, the jet being directed at an area of earth where the china-clay is to be washed out. The water is supplied to the nozzle under high pressure through a supply pipe 2 which is secured to a base 3 and which is further arranged in the form of a loop or coil 4 for countering the reaction thrust of the jet, the supply pipe terminating at the nozzle 1. The supply pipe, above the base, includes a first bearing 5 for pivoting the nozzle 1 about a vertical axis, and a second bearing 6 situated at the beginning of the loop 4 for pivoting the nozzle about a horizontal axis. Pivoting movement of the nozzle is effected by means of hydraulically-operated actuating rams 7 and 8 connected respectively to the bearings 5 and 6 so that the nozzle 1, and hence the jet of water, can be moved in a horizontal or vertical direction or both. The actuating rams 7 and 8 which are double-acting are operated by oil under pressure fed via flexible conduits 10, 11 and 12, 13 from a control unit as will be explained. The flexible conduits are attached to the cylinders by self-sealing releasable couplings.

Figure 2:
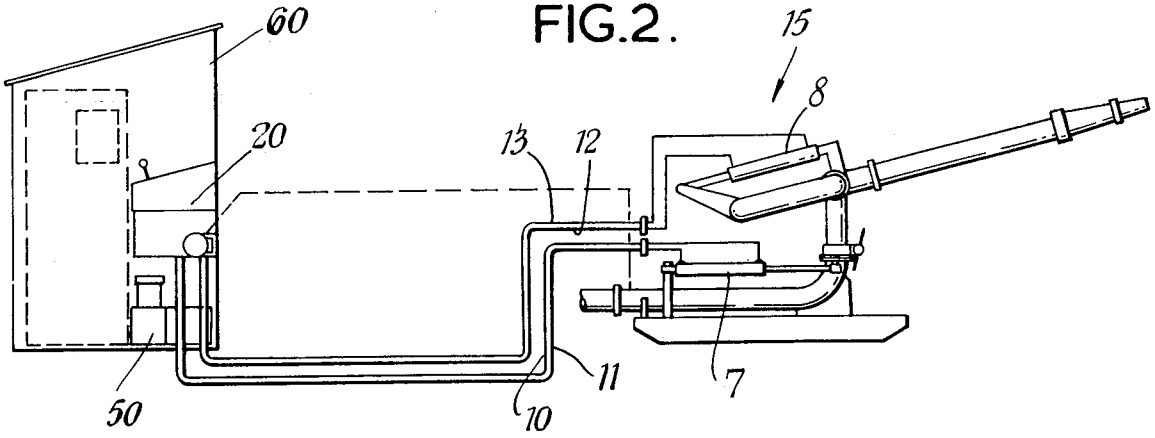
FIG. 2 is a diagrammatic layout showing the arrangement of a monitor together with its remote control unit and a hydraulic power unit; detecting

The general layout of the monitor with its control unit is shown diagrammatically in FIG. 2. This figure shows the monitor, indicated generally at 15, the remote control apparatus 20 and the hydraulic power unit 50 for supplying oil under pressure to the control apparatus. As shown, the four conduits 10, 11 and 12, 13 connect the actuating rams 7 and 8 of the monitor to the control apparatus, oil being supplied through these conduits to operate the actuating rams 7 and 8 for moving the nozzle. The conduits 10, 11 and 12, 13 may be made of any suitable length, normally 100 ft., so that the control apparatus 20 can be located at a safe working distance from the monitor. This feature is required since the high-velocity jet of water from the nozzle 1 causes rocks and mud to be thrown considerable distances owing to the impact with which the water hits the earth.

The control apparatus 20 and its hydraulic power unit are conveniently housed in a hut 60 which further protects the operator and makes operating possible in bad weather conditions.

Figure 3:
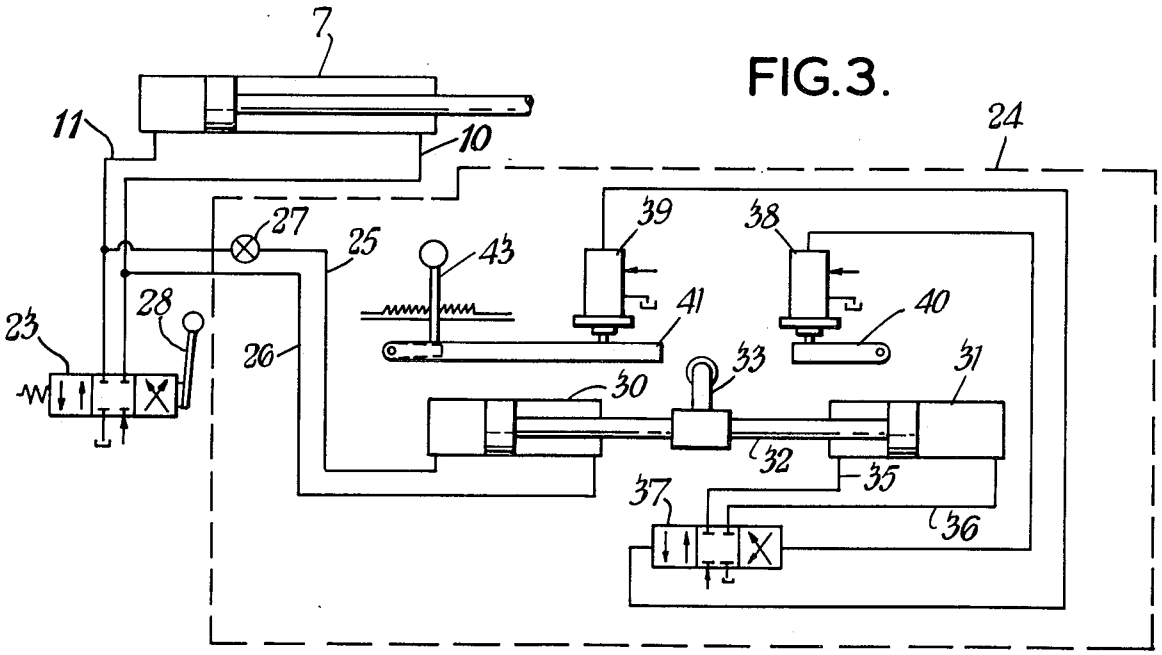
FIG. 3 is a circuit diagram showing the hydraulic circuit of the control apparatus according to the invention.

Using the present invention it is possible for the operator to set a programme on the control apparatus so that operation of the actuating rams 7 and 8 will continue automatically, the programme being selected by the operator according to the way in which the area is to be washed by the water jet. The control circuit by which this is achieved is shown in FIG. 3. This diagram shows the hydraulic circuit for operating one of the actuating rams, for example ram 7 which produces horizontal movement of the nozzle. The circuit for operating the other ram 8 is not shown but is identical in all respects.

The double-acting actuating ram 7 which has oil conduits 10 and 11 connected to opposite ends of its cylinder can be operated in two ways, either manually through the control lever 28 of a manual control valve 23 or through an automatic circuit indicated generally at 24. The manual valve is a directional, 3-position valve in which the valve spool is spring-biassed to its centre closed position. Movement of the valve spool, for example to the left in FIG. 3, puts conduit 10 in communication with an oil reservoir, and admits oil pressure through conduit 11 to the cylinder of the actuating ram 7, causing its ram to move outwardly. Conversely if the valve spool is moved to the right, oil pressure is fed to conduit 10 and conduit 11 is connected to the reservoir, so that the ram of the actuating cylinder moves into the cylinder.

In the centre position of the valve 23, as shown in the Figure, the actuating cylinder 7 is hydraulically locked against movement. transducer For automatic operation, the actuating ram 7 is bars operated through conduits 25 and 26 which communicate with conduits 11 and 10 respectively. Conduit 25 has a needle valve 27 for controlling the rate of flow of oil from the automatic circuit 24 to the ram 7; if the needle valve 27 is closed the ram 7 is isolated from the automatic control.

The control circuit 24 comprises basically two opposed double-acting rams, referred to as a slave FIG. 30 and a master cylinder 31, the pistons of which are directly coupled via a common piston rod 32 which carries a roller 33 for operating latches for reversing the direction at the completion of a stroke of the master and slave rams, as will be explained. The slave cylinder 30 is hydraulically connected to the actuating ram 7 via the conduits 25 and 26 which are connected to opposite ends by the slave cylinder 30, and the bore of the slave cylinder 30 is the same as that of the actuating ram 7 so that reciprocating movement of the slave ram will cause exactly corresponding reciprocating linear movement of the actuating ram 7.

The master cylinder 31 is operated by oil pressure supplied from the hydraulic power unit 50 through conduits that a and 36 under the control of a pilot-operated, 3-position directional valve 37, the centre position of the spool being a closed position. This reversing valve surface is operated by two pilot valves 38 and 39 which are operated by hydraulic pressure and actuated by associated latches 40 and 41 which are arranged to be depressed in turn by the roller 33 on the piston rod 32. Thus in operation the master ram moves in one direction until the roller 33 depresses one of the latches, say 40 which operates its associated pilot valve 38, thereby changing over the main valve 37 to reverse the direction of movement of the master ram. At the other end of the stroke, roller 33 will depress the latch 41, again to reverse the valve 37 through the pilot valve 39. The reciprocating movement of the master ram 31 produces corresponding reciprocating movement of the slave ram 30 which in turn effects reciprocating movement of the actuating ram 7, thereby to oscillate the water jet horizontally.

One of the latches 41 is adjustable by means of a lever 43 which in a particular construction can be set in any one of 13 positions, the position of the latch determining the length of stroke of the master ram 31 and therefore the length of stroke of the actuating ram 7.

As explained, the other actuating ram 8 for vertical movement of the nozzle is also controlled by a similar automatic control circuit.

Figure 5:
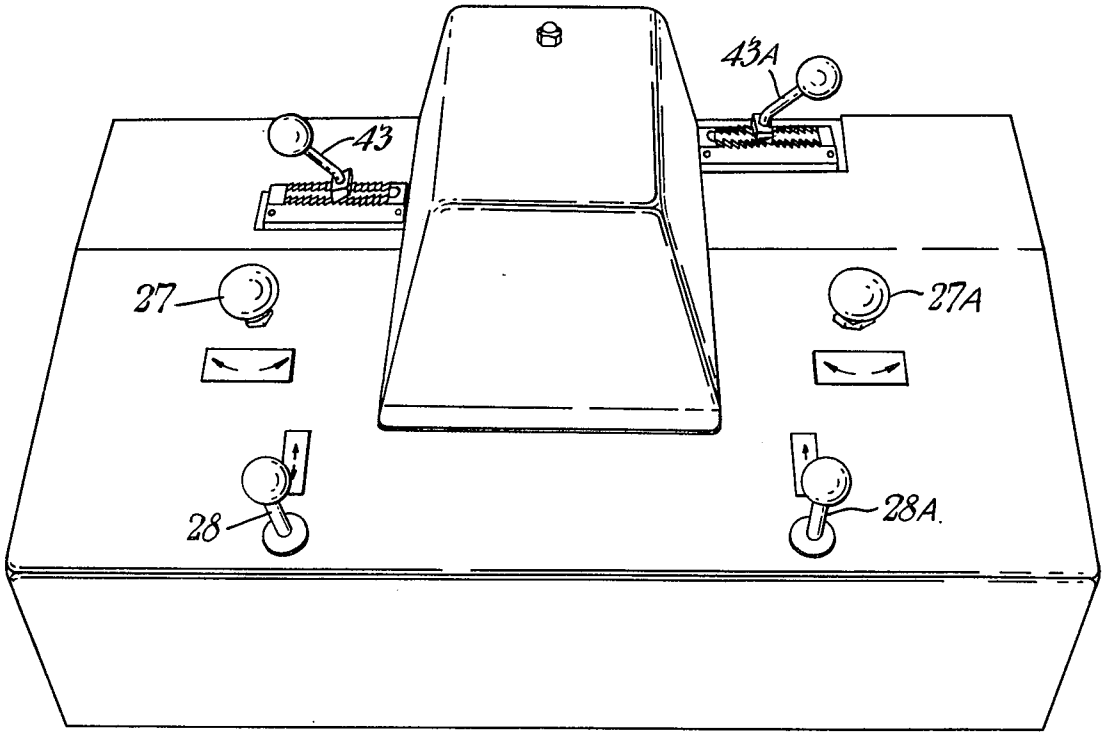
FIG. 5 is a perspective view of the control unit, showing the controls.

FIG. 5 shows the control unit with the various controls: the control lever 28, the needle valve 27 and the stroke adjustment lever 43 for controlling the horizontal actuating ram 7; and corresponding controls 28A, 27A and 43A for controlling the vertical actuating ram 8.

It will be appreciated therefore that by selecting the stroke and speed of actuation of each of the actuating rams 7 and 8, using the controls 43, 43A and 27, 27A, a wide range of automatic working programmes can be achieved. Once set, a programme will be followed continuously, until the operator changes the controls. If the operator decides to move the jet to a new washing position all that is necessary is to operate the relevant manual valve 23, by means of its control lever 28 or 28A, which will then override the automatic control until the control lever is released, when the valve spool will again return to its centre, locked position and the pre-selected programme will re-commence.

In the embodiment described the slave cylinder has a maximum stroke of 4'' whereas the actuating ram 7 has a maximum stroke of 15''. Thus under automatic control the range of movement is only a proportion of the maximum range; for example, the horizontal movement possible with a full stroke of the actuating ram 7 may constitute a swing through 120° of the jet and under automatic control the maximum horizontal swing would be 32°; this provides a safe and effective range in practice. If the jet is required to be directed at an area lying outside the 120°, the nozzle assembly can be swung round to a new direction by means of a clamp 14, shown in FIG. 1.

A feature of the construction is the safety, in that, if by accident one of the conduits is cut or torn away from its coupling, the oil under pressure which is normally fed to the actuating rams 7 and 8 will vent to atmosphere and movement of the nozzle will cease. Furthermore, since under automatic operation the actuating rams 7 and 8 are in a closed hydraulic circuit with their associated slave cylinders, there is no danger of drift outside the programmed range, provided there is no leakage of oil past those rams.

Figure 4:
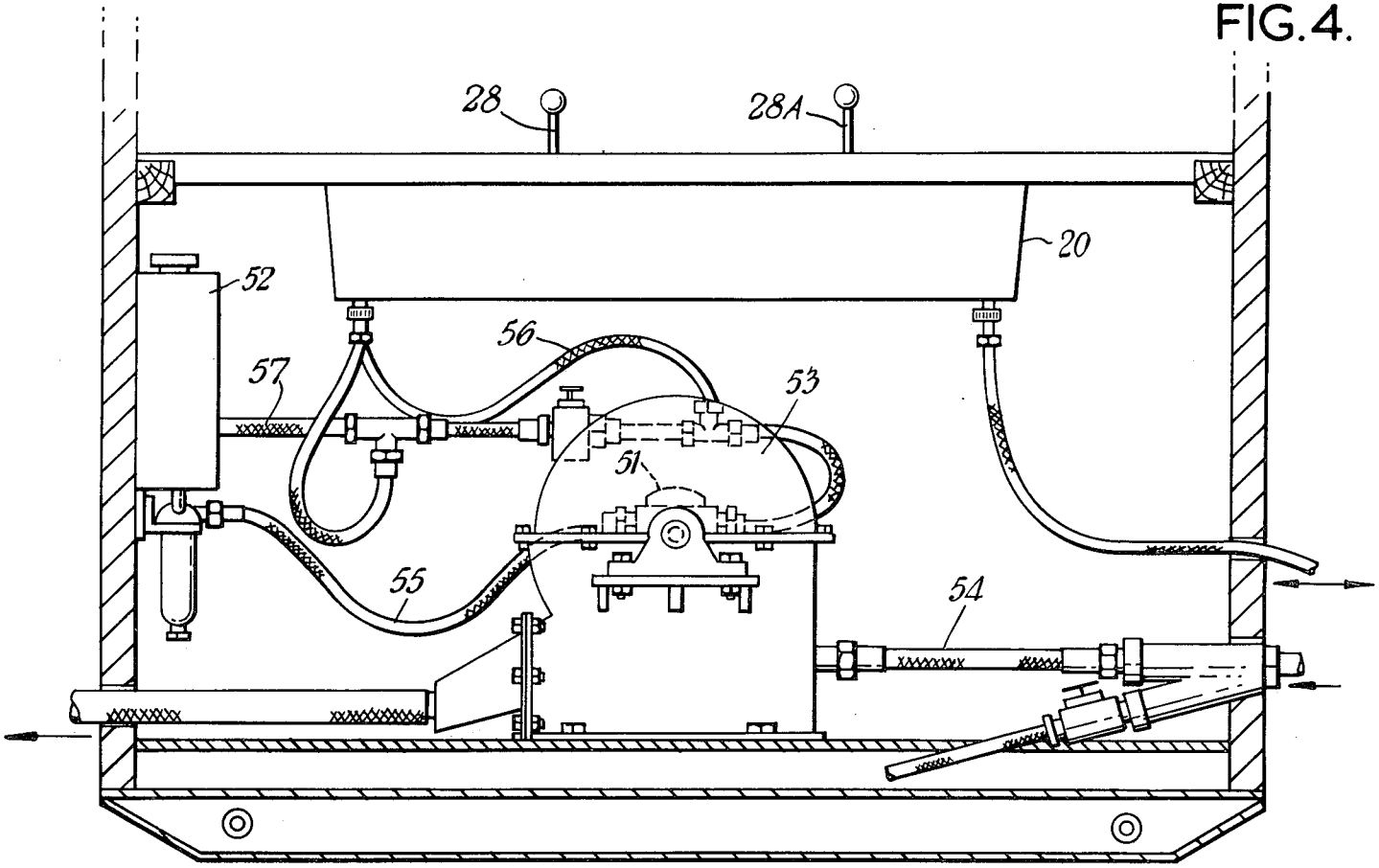
FIG. 4 is a view of the hydraulic power unit which supplies oil under pressure to the control apparatus.

The hydraulic pressure for operating the master ram 31, and the corresponding master ram of the vertical movement control circuit, is supplied by the power unit 50, as illustrated in FIG. 4. The oil pressure for the control apparatus is supplied from an oil pump 51 which pumps oil from a reservoir 52 via a conduit 55 and thence under pressure to the control apparatus 20 via a pressure supply conduit 56. An oil return conduit 57 returns oil from the control apparatus to the reservoir 52.

The oil pump 51 is driven by a simple water-powered invention l. Pelton wheel arrangement 53 — the Pelton wheel being driven by water under pressure fed through an inlet pipe 54 from the water supply pipe 2 which supplies the wash water to the nozzle. This provides a simple and efficient arrangement to it is found that 5 gallons of water per minute provides adequate power. It will be appreciated that this feature provides a self-contained power unit obviating the expense and danger of electrical power lines.

Furthermore since the monitor, the control unit and the power unit are interconnected by quick release couplings any one of these units may be replaced quickly in event of trouble thereby avoiding loss of operating time and 0.25, the need to service the units in difficult conditions.

In a further specific embodiment, not shown in the drawings, a single control circuit, as shown in FIG. 3, is used to control automatically either a vertical movement actuating ram or a horizontal movement actuating ram but not both simultaneously. In this case the slave ram is connected hydraulically to both vertical and horizontal actuating rams via a manual valve which can be operated to engage automatic control for whichever actuating ram is selected. Since only one control circuit is used in this case the control apparatus is simpler and less expensive to install.

I claim:

1. Hydraulic actuating system comprising a reciprocating double-acting hydraulic actuating ram, including a piston and cylinder, and hydraulic control means for the automatic remote control of the reciprocating movement of the hydraulic actuating ram, the hydraulic control means comprising a first double-acting ram including a slave piston and slave cylinder, opposite ends of the slave cylinder being connected hydraulically to respective opposite ends of the cylinder of the actuating ram such that reciprocating movement of the slave piston causes reciprocating movement of the actuating ram, a second double-acting ram including a master piston and master cylinder, the slave piston and the master piston being connected by a common piston rod, directional valve means for controlling the hydraulic pressure supply to the master cylinder, the directional valve means being arranged to reverse automatically the direction of movement of the master piston, pilot means adapted to control the directional valve means, and limit switch means adapted to actuate the pilot means for determining the desired length of stroke of the actuating buildups,

2. Hydraulic actuating system as claimed in claim 1, wherein the directional valve means is a directional valve adapted in one position to apply hydraulic pressure to one side of the master piston and to connect the master cylinder at the other side of the master piston to a drain, and in a second position to reverse the connections to the master cylinder.

3. Hydraulic actuating system as claimed in claim 1, wherein the pilot means comprises two hydraulic pilot valves operable at respective opposite ends of the stroke of the master piston, the pilot valves being actuated by the limit switch means.

4. Hydraulic actuating system as claimed in claim 3, wherein the limit switch means comprises two limit switches, associated respectively one with each hydraulic pilot valve, the limit switches being operable by a dog connected to the common piston rod and moved therewith.

5. Hydraulic actuating system as claimed in claim 3, wherein the limit switch means includes means for adjusting the position of at least one of the limit switches the position of the limit switch determining the length of the stroke of the master and slave pistons.

6. Hydraulic actuating system comprising a reciprocating double-acting hydraulic actuating ram, including a piston and cylinder, and hydraulic control means for the automatic remote control of the reciprocating movement of the hydraulic actuating ram, the hydraulic control means comprising a first double-acting ram including a slave piston and slave cylinder, opposite ends of the slave cylinder being connected hydraulically to respective opposite ends of the cylinder of the actuating ram such that reciprocating movement of the slave piston causes reciprocating movement of the actuating ram, a second double-acting ram including a master piston and master cylinder, the slave piston and the master piston being connected by a common piston rod, directional valve means for controlling the hydraulic pressure supply to the master cylinder, the directional valve means being arranged to reverse automtically the direction of movement of the master piston, pilot means adapted to control the directional valve means, limit switch means adapted to actuate the pilot means for determining the desired length of stroke of the actuating ram, and an adjustable flow control valve means operatively connected to the slave cylinder for controlling the rate of movement of the actuating ram.

7. Hydraulic actuating system as claimed in claim 6, wherein the control means includes a manually-operable hydraulic valve for controlling a hydraulic supply to the hydraulic actuating ram, the manual valve, when operated, overriding the automatic control of the hydraulic actuating ram.

8. Hydraulic actuating system as claimed in claim 7, wherein the manually-operable hydraulic valve is a directional, 3-position closed centre type valve, the valve being spring-biassed to its centre position.

* * * * *